US008720101B2

(12) United States Patent
Nelson et al.

(10) Patent No.: US 8,720,101 B2
(45) Date of Patent: May 13, 2014

(54) SHOOTING BENCH

(75) Inventors: Ronald D. Nelson, Sidney, NE (US); Luke Humphreys, Sidney, NE (US); Ryan E. Wellman, Sidney, NE (US)

(73) Assignee: Cabela's, Sidney, NE (US)

( * ) Notice: Subject to any disclaimer, the term of this patent is extended or adjusted under 35 U.S.C. 154(b) by 179 days.

(21) Appl. No.: 13/228,076

(22) Filed: Sep. 8, 2011

(65) Prior Publication Data

US 2013/0061508 A1 Mar. 14, 2013

(51) Int. Cl.
*F41A 23/10* (2006.01)
*F41A 23/16* (2006.01)

(52) U.S. Cl.
CPC ..... *F41A 23/10* (2013.01); *F41A 23/16* (2013.01)
USPC ..... 42/94; 89/37.04

(58) Field of Classification Search
USPC ..... 42/94; 89/37.04
See application file for complete search history.

(56) References Cited

U.S. PATENT DOCUMENTS

| | | | | |
|---|---|---|---|---|
| 3,608,852 | A * | 9/1971 | Horn | 248/166 |
| 4,967,497 | A * | 11/1990 | Yakscoe | 42/94 |
| 5,715,625 | A * | 2/1998 | West, III | 42/94 |
| 6,269,578 | B1 * | 8/2001 | Callegari | 42/94 |
| 6,574,899 | B1 * | 6/2003 | Mostello | 42/94 |
| 6,578,309 | B1 * | 6/2003 | Frisce | 42/94 |
| 6,871,440 | B2 * | 3/2005 | Highfill et al. | 42/94 |
| 6,935,064 | B1 * | 8/2005 | Thompson | 42/94 |
| 2008/0047188 | A1 * | 2/2008 | Lindstrom | 42/94 |

* cited by examiner

*Primary Examiner* — Stephen M Johnson
(74) *Attorney, Agent, or Firm* — Quarles & Brady LLP

(57) ABSTRACT

A shooting bench includes a frame having at least two legs. The at least two legs are connected at a pivot. A table is connected to the frame at a first bracket. The first bracket is configured to slide along a length of a first one of the at least two legs to transition the shooting bench between a deployed configuration and a collapsed configuration. The table may include a cross bar. A gun mount may be adjustably coupled to the crossbar of the table. A first locking device can be mounted to the crossbar and configured to selectively permit movement of the gun mount in a first direction with respect to the table. A second locking device can be mounted to the cross bar and configured to selectively permit movement of the gun mount in a second direction with respect to the table.

15 Claims, 12 Drawing Sheets

SHOOTING BENCH

FIELD OF THE INVENTION

The disclosure relates in general to shooting benches and, more particularly, to shooting benches having adjustable weapon mounts and seating surfaces.

BACKGROUND OF THE INVENTION

When firing a weapon, stability is an important factor in determining the accuracy of a shot. Even small deflections of a weapon's barrel can result in shots that deviate significantly from the target. To improve stability, marksmen will often use a stable surface, such as the ground, a tree limb, or artificial structure as support. The stable surface allows a marksman to carefully aim before firing by making precise adjustments to the position of the weapon. In some cases, when target shooting, for example, the marksman uses a purpose-built device such as a shooting bench or table to support the weapon.

In addition to stability, a marksman must adopt correct posture when shooting. Correct posture allows a marksman to make very fine adjustments to a shot's aim. Additionally, good posture can be maintained by a marksman for a longer time period without discomfort or injury.

SUMMARY OF THE INVENTION

The disclosure relates in general to shooting benches and, more particularly, to shooting benches having adjustable weapon mounts and seating surfaces.

In one implementation, a shooting bench includes a frame including at least two legs. The at least two legs are connected at a pivot. The bench includes a table connected to the frame at a first bracket. The first bracket is configured to slide along a length of a first one of the at least two legs to transition the shooting bench between a deployed configuration and a collapsed configuration. The table includes a cross bar. The bench includes a gun mount adjustably coupled to the crossbar of the table, and a first locking device mounted to the crossbar and configured to selectively permit movement of the gun mount in a first direction with respect to the table. The bench includes a second locking device mounted to the cross bar and configured to selectively permit movement of the gun mount in a second direction with respect to the table.

In another implementation, a shooting bench includes a frame including at least a first leg. The bench includes a table connected to the frame at a first bracket. The first bracket is configured to slide along a length of the first leg to transition the shooting bench between a deployed configuration and a collapsed configuration. The bench includes a gun mount adjustably coupled to the table.

In another implementation, a shooting bench includes a frame including at least a first leg, and a table connected to the frame. The bench includes a seat mounted to the frame. The seat is configured to be selectively repositioned between a stowed position and a deployed configuration. The bench includes a gun mount adjustably coupled to the table.

DETAILED DESCRIPTION OF THE DRAWINGS

This disclosure relates in general to shooting benches and, more particularly, to shooting benches having adjustable weapon mounts and seating surfaces.

In one embodiment, a shooting bench is adjustable to allow a marksman to precisely aim a weapon while also adopting a comfortable posture. In various implementations, the bench incorporates an adjustable forward-sloping seat that allows the marksman to sit comfortably without having to lean forward at an uncomfortable angle. The bench may also incorporate a weapon mount that is adjustable along three separate axes allowing the weapon's barrel to be placed in a comfortable position for the user. Additionally, the table surface of the shooting bench may be configured to include elbow and chest supports to provide additional comfort, support, and stability to the marksman.

In various implementations, different components of the seating bench are collapsible. As described below, the seat portion of the shooting bench is configured to transition between a deployed configuration, in which a user can use the seat, to a stowed or collapsed configuration, in which the seat is folded upwards and fixed in a stowed or collapsed position to improve portability of the bench. Additionally, the supporting frame of the shooting bench can be collapsed. When collapsed, the bench occupies a smaller volume, allowing the bench to be easily moved from one location to the next.

Figure 1:
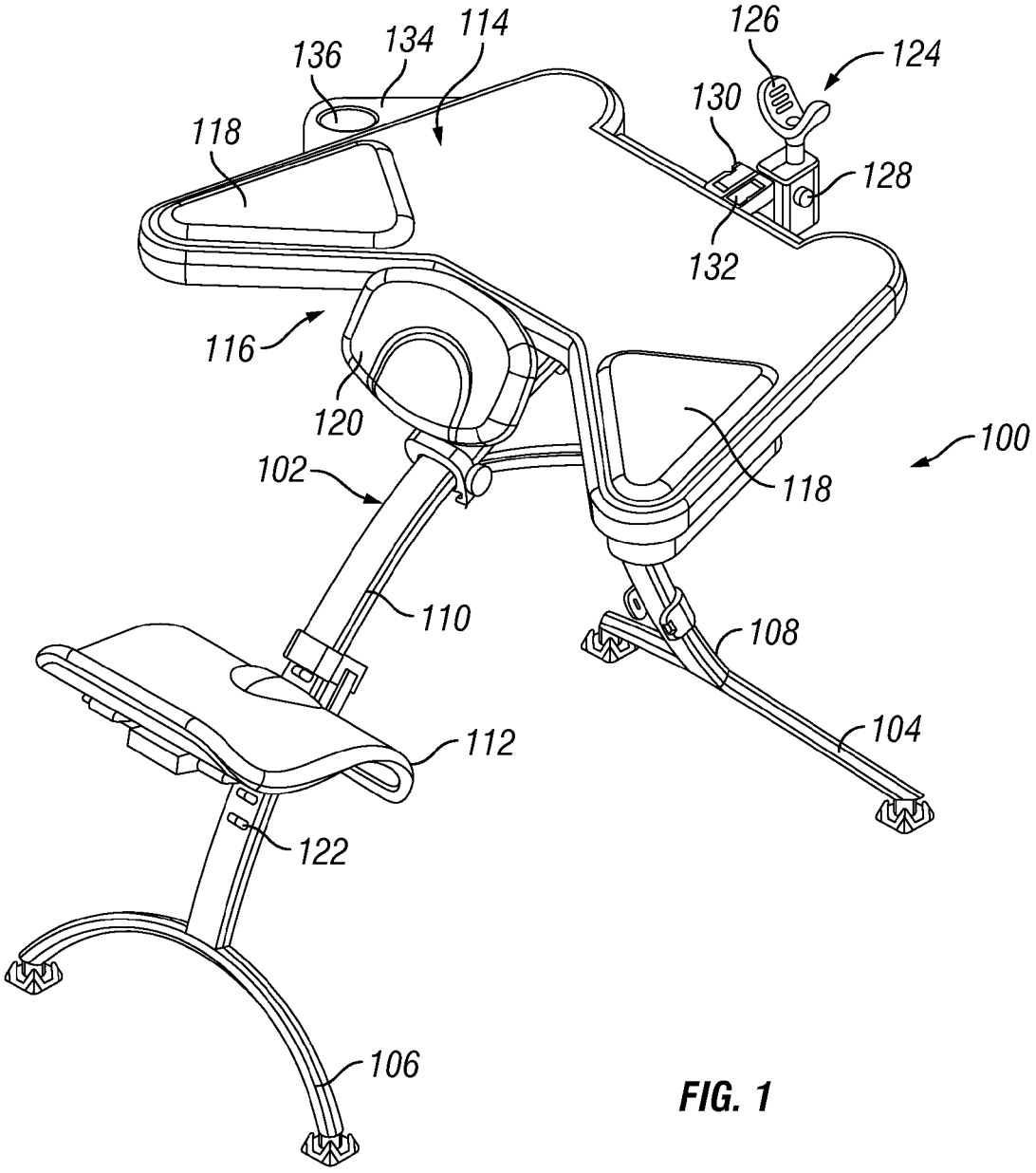
FIG. 1 is a perspective view of one embodiment of a shooting bench.
Figure 2:
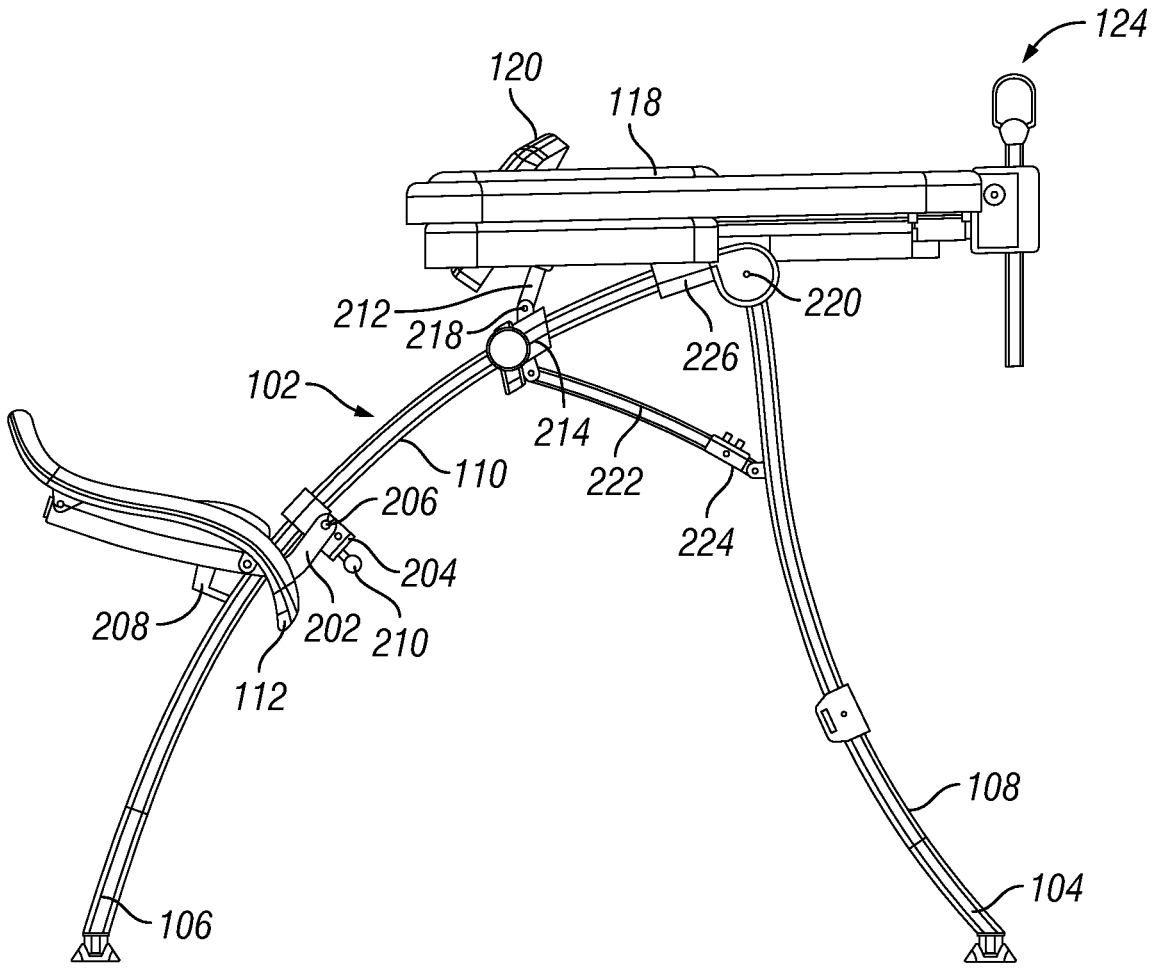
FIG. 2 is a right-side view of the shooting bench shown in FIG. 1.

FIG. 1 is a perspective view of one implementation of the present shooting bench. FIG. 2 is a right-side view of bench 100 shown in FIG. 1. Bench 100 includes frame 102. Frame 102 provides a general support structure for carrying the components of shooting bench 100. Frame 102 is constructed using materials that are sufficiently strong to support an individual using the bench as well as the various components of the bench and a number of weapons and ammunition. Example materials include metals and plastics or any other appropriate materials that can be formed into frame 102, while providing the requisite strength. In one implementation, frame 102 comprises a number of metal tubes that are welded together to form frame 102.

Frame 102 includes front leg 108 and back leg 110. Front foot structure 104 is connected to front leg 108 and back foot structure 106 is connected to back leg 110. Foot structures 104 and 106 are configured to provide stability to frame 102 when deployed against a ground surface. As such, foot structures 104 and 106 include feet positioned laterally away from frame 102 in order to contact a ground surface at wide contact points to provide stability to bench 100. To provide additional stability, the feet of foot structures 104 and 106 may be coated with 'non-slip' surfaces to ensure that the feet do not slide across the ground. Depending upon the anticipated surface (e.g., snow/ice, wet dirt, grass, sand, rocks, etc.) the feet and any coatings thereon can be selected to provide optimum grip. The feet may be connected to foot structures 104 or 106 using a ball and socket connection. Such a connection allows the bottom surfaces of the feet to self-adjust to the ground surface, providing additional stability and support to bench 100. In other implementations, different feet configurations may be used. For example, the feet of back foot structure 106 may be replaced by a single pad or foot. In that case, bench 100 would stand upon only three feet, with the front feet providing lateral stability. Alternatively, the feet may be adjustable, so that a height of each foot can be adjusted individually, allowing for bench 100 to be positioned on uneven ground in a stable manner. Additionally, the width of the front and back foot structures can be adjusted, for example by making the back foot structure narrower than the front foot structure.

Seat 112 is connected to back leg 110 of frame 102 and provides a surface upon which a marksman can sit while using bench 100. As shown in FIG. 1, seat 112 can be contoured to provide comfort to the user. Alternatively, though, seat 112 may take other configurations (e.g., as a planar surface, bicycle-style seat, tractor-style seat, or saddle) depending upon the comfort requirements of the user, or other factors, such as the cost or ease of manufacture. In one implementation, the seat comprises a plastic substrate over which ethylene-vinyl acetate (EVA) foam, or other padded foams, are molded to provide cushioning.

In the implementation shown in FIG. 1, seat 112 is mounted to back leg 110 such that when seat 112 is deployed, seat 112 has a forward cant or slope. This forward cant is selected to facilitate a user adopting an optimum or preferred posture when using bench 100. In one implementation, the top surface of seat 112 has a downward slope of approximately 15 degrees with respect to the top surface of table 114 when positioned mid-way along back leg 110. Because leg 110 is curved, the angle of seat 112 with respect to the ground surface varies as seat 112 moves along leg 110, with the angle increasing (i.e., the angle of seat 112 becomes steeper) as seat 112 moves forward along leg 110 towards the front of bench 100. In another implementation, an adjustment control may be integrated into seat 112 to allow a user to modify the angle of seat 112 at each position along leg 110. Such a posture allows the user to more easily lean forward to hold a weapon for use in conjunction with bench 100 allowing for increased comfort. By making the marksman's position more comfortable, the marksman can use the bench for extended periods of time without risk of discomfort from cramping, or pressure points.

With reference to FIG. 2, seat 112 is connected to frame 102 by strut 202 and bracket 204. Bracket 204 is configured to slide along a length of back leg 110 to allow a user to modify a position of bracket 204 and, consequently, seat 112, along leg 110. In one implementation, nylon or plastic bushings are incorporated into bracket 204 to allow bracket 204 to more easily slide along leg 110. In fact, all brackets of bench 100 configured to slide along a length of frame 100 may incorporate such bushings to facilitate movement. For example, a user may adjust a height of seat 112 based upon the height of the user to allow the user to sit comfortably at bench 100. Alternatively, the position of seat 112 may be selected based upon a type of weapon being used in conjunction with bench 100. For longer weapons, seat 112 may be positioned further back, whereas for shorter weapons seat 112 may be positioned further forward, closer to mount 124, for example.

Strut 202 is configured to rotate about bracket 204 at pivot point 206. In the present implementation, strut 202 comprises two separate strut components that are connected between seat 112 and either side of bracket 204—see FIG. 6A, for example. Bracket 204 includes a pin for locking a position of bracket 204 when seat 112 is disposed into the stowed or collapsed configuration, as described in detail below.

Seat 112 includes locking arm 208 for fixing a position of seat 112 with respect to leg 110 when seat 112 is in use. To fix seat 112 in a particular position when deployed, seat 112 is rotated downwards in order to place locking arm 208 into one of a number of locking holes 122 formed on the upper outer surface of leg 110 (see FIG. 1). Then, to adjust the position of seat 112, seat 112 is rotated or lifted upward about pivot point 206 causing locking arm 208 to withdraw from the current locking hole 122. Bracket 204 can then be slid along leg 110 to adjust a position of seat 112. When bracket 204 and seat 112 are in the desired position, seat 112 (and locking arm 208) is rotated downwards allowing locking arm 208 to engage with a new locking hole 122 at the desired position. With locking arm 208 disposed within the selected locking hole 122, seat 112 (and strut 202) can no longer rotate downwards about pivot 206. Additionally, locking arm 208 prevents bracket 204 from sliding along leg 110. In that configuration, a user can use seat 112 with seat 112 being supported by locking arm 208 pressing against a lower edge of the locking hole 122 into which locking arm 208 is inserted.

In other implementations, rather than fix a position of seat 112 using a combination of locking arm 208 and locking holes 122, seat 112 may instead (or in combination with locking holes 122) be coupled to leg 110 using an adjustable friction coupling, whereby friction is utilized to minimize or prevent movement of seat 112 along leg 110 during use. For example, in one implementation, rather than include locking holes 122, the upper surface of leg 110 is constructed to include a rough surface. In that case, the end of locking arm 208 that is not fixed to seat 112 may include a rubber or other conforming surface configured to generate friction when pushed against the rough surface of leg 110. In such an implementation, when the user sits on seat 112, the weight of the user would cause the rubber or conforming portion of locking arm 208 to press against the rough surface of leg 110 generating substantial friction and effectively fixing the position of seat 112. In another implementation, strut 202 is fixed to bracket 204 to prevent rotation of strut 202 about bracket 204 and, consequently, seat 112. In that case, bracket 204 may directly incorporate a locking mechanism that allows for the position of bracket 204 and seat 112 to be selectively adjusted along leg 110.

Figure 6A:
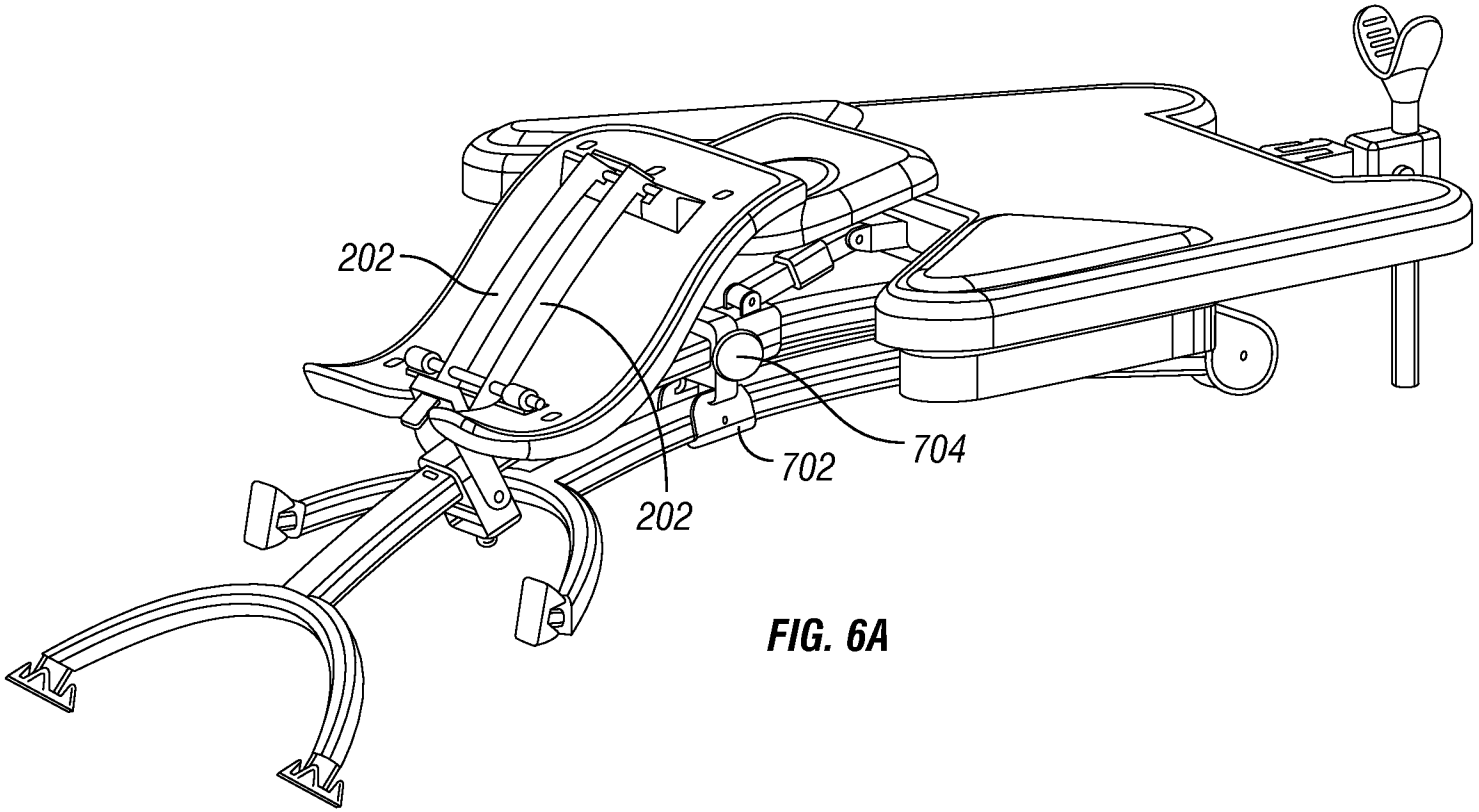
FIGS. 6A and 6B show perspective and side views of the present shooting bench in a collapsed configuration, respectively.
Figure 6B:
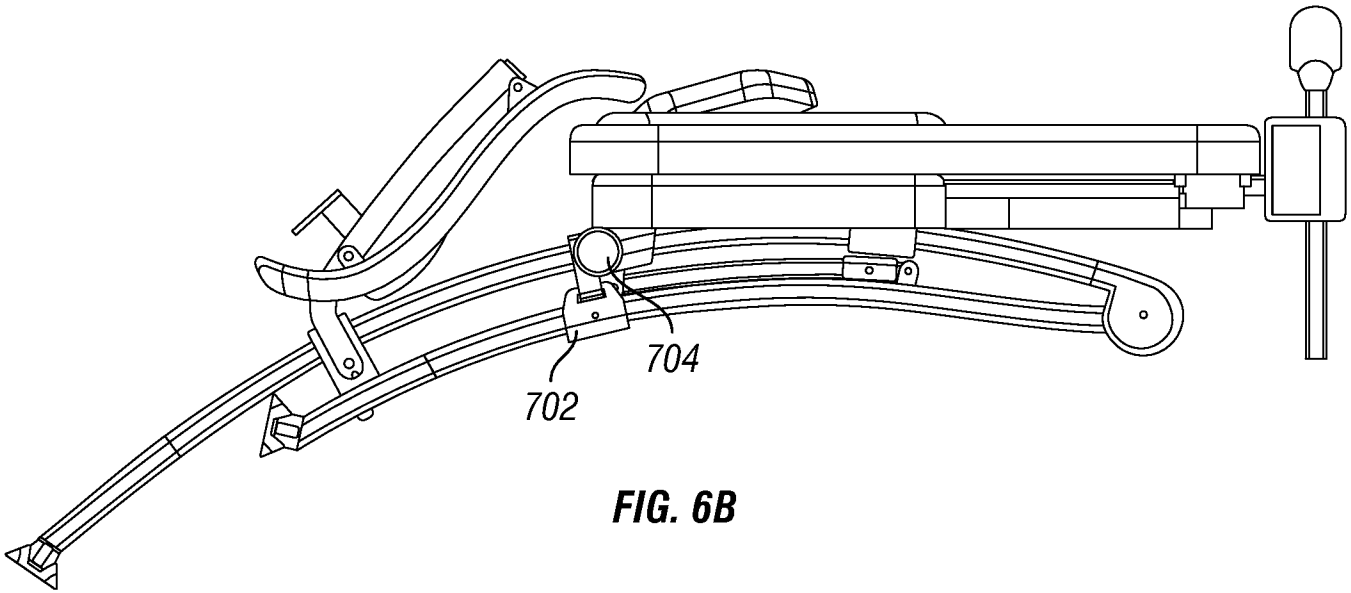

In addition to operating as a seat for a user, seat 112 can be placed into a stowed or collapsed configuration to provide for easier storage and/or movement of bench 100. In the stowed or collapsed configuration, seat 112 is folded upwards and bracket 204 is slid along leg 110 into a stowed or collapsed configuration (see, for example, FIGS. 6A and 6B showing seat 112 in a stowed or collapsed configuration).

Figure 3A:
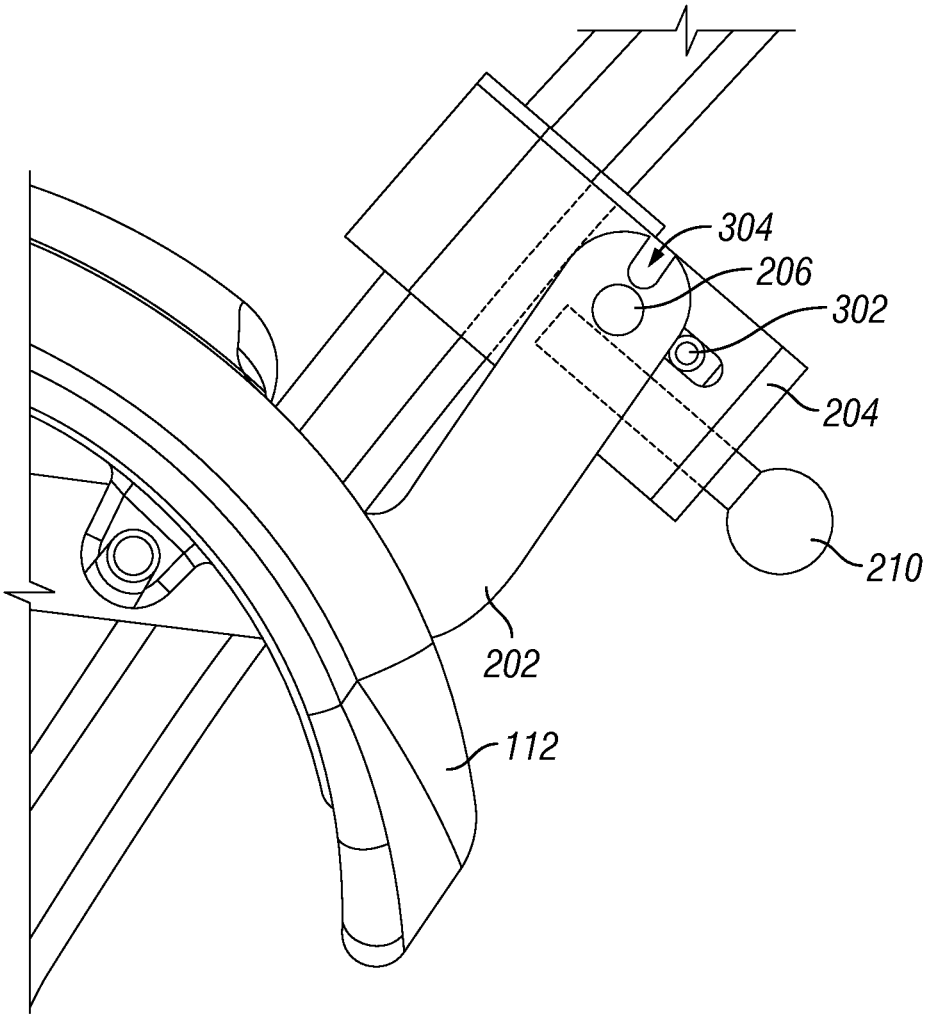
FIG. 3A is a detail view showing a seat and seat bracket in a deployed configuration.
Figure 3B:
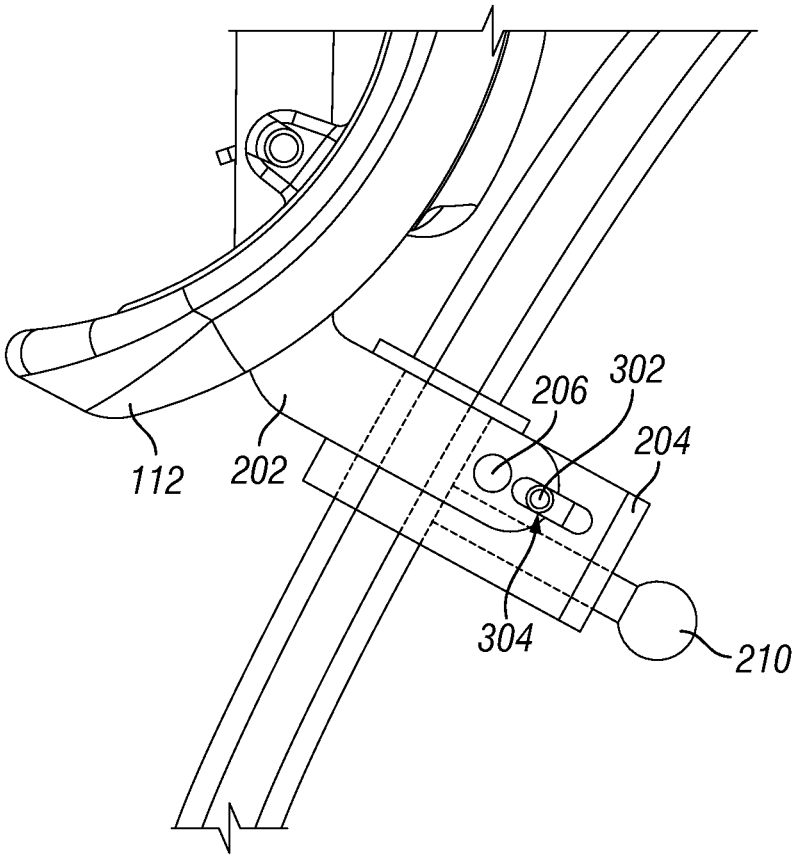
FIG. 3B is a detail view showing the seat and seat bracket after being placed into a configuration suitable for stowing the seat.
Figure 3C:
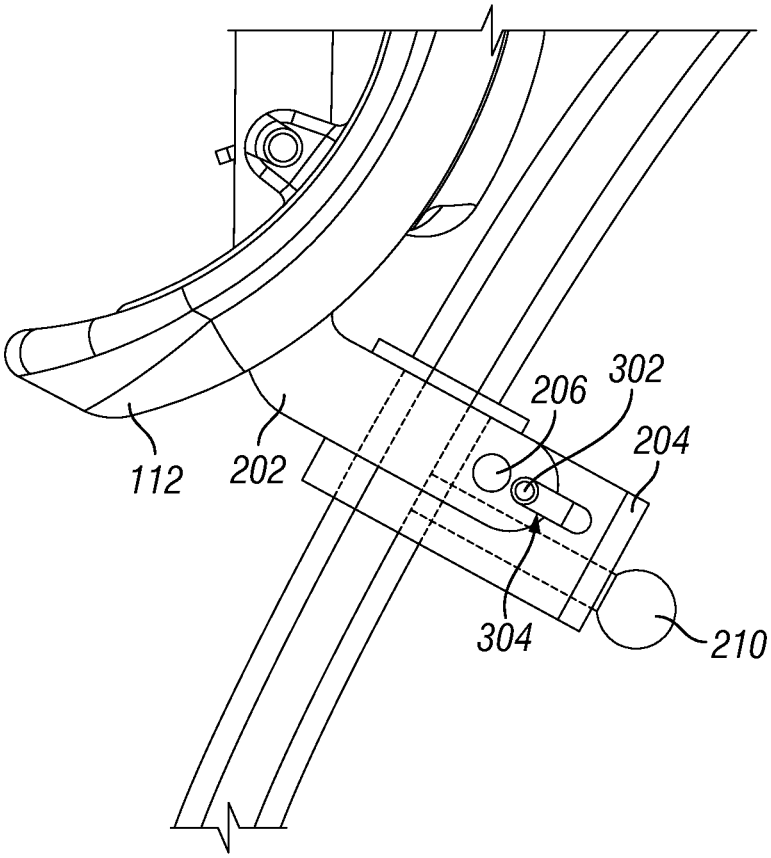
FIG. 3C is a detail view showing the seat and bracket in a stowed or collapsed configuration.

FIG. 3A is a detail view showing seat 112 and bracket 204 in their deployed, locked configuration, FIG. 3B is a detail view showing seat 112 and bracket 204 after being placed into a configuration suitable for stowing seat 112, and FIG. 3C is a detail view showing seat 112 and bracket 204 in a stowed or collapsed configuration. As shown in FIG. 3A, pin 210 is mounted to, and resides partially within, bracket 204. Pin 210 is fixed to pin rod 302 that can also move within bracket 204. As such, movement of pin 210 with respect to bracket 204 is controlled by pin rod 302, and vice versa. Therefore, as pin 210 moves back and forth within bracket 204, rod 302 moves in a corresponding direction and by the same distance. If rod 302 is fixed, pin 210 is unable to move.

During use of seat 112 in its deployed position (as shown in FIG. 3A), pin 210 extends through bracket 204, but (as shown by the dashed line). Although pin 210 includes a bias spring (not shown) for biasing a position of pin 210 towards leg 110, as the edge of strut 202 contacts rod 302, pin 210 is unable to move further toward or press against leg 110. Accordingly, when seat 112 is deployed (i.e., configured as a seat for use by a user), pin 210 is fixed in a withdrawn position. In that configuration, bracket 204 is free to slide along a length of leg 110 to allow for repositioning of seat 112, as described above.

To place seat 112 into its stowed or collapsed configuration, as shown in FIG. 3B, seat 112 is first folded upwards by rotating strut 202 (and seat 112) about pivot 206. As strut 202 is rotated upwards, notch 304 of strut 202 is positioned in-line with rod 302. Because pin 210 is biased towards leg 110, when notch 304 is in line with rod 302, rod 302 is able to enter notch 304 causing rod 302 and pin 210 to both move towards leg 110. In this configuration, the distal end of pin 210 contacts and pushes against the undersurface of leg 110. Also, rod 302 is positioned within notch 304 of strut 202, preventing rotation of strut 202 and, thereby, movement or rotation of seat 112. As seen in FIG. 3B, in this configuration notch 304 is sufficiently long so that event after pin 210 contacts the undersurface of leg 110, rod 302 can still move further into notch 304.

After folding seat 112 upwards into its stowed or collapsed configuration, bracket 204 can be slid along leg 110 into the bracket 204's stowed position. At the bracket's stowed position, a locking hole (not shown) is formed in the underside of leg 110. The locking hole is configured to receive pin 210. Because pin 210 is now biased against leg 110, when bracket 204 reaches its stowed position, pin 210 is pushed into and engages with the locking hole. Accordingly, as shown in FIG. 3C, rod 302 is pushed by the bias spring of pin 210 all of the way into notch 304 allowing pin 210 to enter the locking hole on the underside of leg 110. In this position, seat 112 is locked in its stowed or collapsed configuration because rod 302 has engaged notch 304 of strut 202 preventing rotation of strut 202. Additionally, bracket 204 is locked to prevent movement of bracket 204 along leg 110 because pin 210 has engaged the hole formed on the underside of leg 110. In this configuration, seat 112 is locked into its stowed position, as depicted in FIGS. 6A and 6B.

To exit the stowed or collapsed configuration, the user pulls on pin 210 to compress the bias spring and withdraw pin 210 from the hole formed on the underside of leg 110. As pin 210 is withdrawn, rod 302 is also withdrawn by a corresponding distance from notch 304 of strut 202 causing rod 302 to withdraw from notch 304. At that point, seat 112 (and strut 202) can be rotated downwards into their normal deployed configuration. By rotating strut 202 (and thereby moving the position of notch 304), the edge of strut 202 blocks movement of rod 302, preventing pin 210 from re-engaging the hole formed in the underside of leg 110 at bracket 204's stowed position. Bracket 204 can now be slid along a length of leg 110 to the user's desired seating position. Once in position, locking arm 208 of seat 112 (shown in FIG. 2) can be positioned into one of locking holes 122 formed on the upper surface of leg 110 (see FIG. 1) by rotating seat 112 and strut 202 downwards. With locking arm 208 in position, the user can use seat 112.

Returning to FIGS. 1 and 2, bench 100 includes table 114 connected to frame 102 at table bracket 226 (shown on FIG. 2). Table bracket 226 is configured to slide along a length of leg 110 to allow bench 100 to be collapsed.

An optional side table 134 may be mounted to an undersurface of table 114. Side table 134 may be fixed, or be configured to be optionally stowed under table 114. For example, side table 134 may be configured to slide out from under table 114 using a rail system. Alternatively, side table 134 may be connected to the underside of table 114 at a pivot allowing side table 134 to be rotated outwards from underneath table 114. An optional well or recess 136 may be formed within side table 134 allowing for storage of various articles including ammunition, tools, snacks, drinks, etc. Any number of side tables may be mounted under table 114. For example, the table 114 illustrated in FIG. 1 may be replicated underneath the right side of table 114.

Front leg 108 and back leg 110 of frame 102 are connected at pivot point 220 (shown on FIG. 2). Legs 108 and 110 are each configured to rotate about pivot point 220.

Table 114 may be configured to include arm rests 118. In the implementation of FIG. 1, arm rests 118 are integral with table 114 and are formed as contoured extensions of the surface of table 114. In other implementations, though, arm rests 118 may be formed as separate structures that are connected to table 114, frame 102 or another component of bench 100. In that configuration, the arm rests can be removable, for example, allowing a user of bench 100 to install only a single arm rest. As shown in FIG. 1, optional pads may be mounted over one or more of arm rests 118 to provide additional comfort. In one implementation, table 114 comprises a plastic substrate. A foam surface (e.g., EVA foam) is formed over a surface of table 114 to provide padding for a user of bench 100. For the regions of table 114 comprising arm rests 118, thicker deposits of foam (e.g., EVA form) are formed to provide additional padding to the user. In such a configuration, arm rests 118 are not removable and are permanently attached to table 114.

An optional chest plate 120 may be mounted to frame 102 between arm rests 118. Chest plate 120 provides a surface upon which a user of bench 100 can rest his or her chest while using bench 100. Chest plate 120 may include an optional cushion or padding to provide additional comfort for the user.

In one implementation, chest plate 120 is mounted to frame 102 and table 114 so that the top surface of chest plate 120 is positioned at a predetermined angle with respect to the top surface of table 114. The angle is generally selected to match the angle of the surface of a marksman's chest as he uses bench 100. In one particular implementation, the angle is approximately 45 degrees. The top surface of chest plate 120 may be contoured to provide further comfort to the marksman.

As seen in FIG. 2, chest plate 120 is connected to frame 102 at support arm 212 that is connected between table 114 and bracket 214. Support arm 212 is connected to both bracket 214 and table 114 at pivots.

Bracket 214 is mounted to leg 110 of frame 102 and is configured to slide along a length of leg 110. In one implementation, bracket 214 may be configured to include a control for optionally fixing bracket 214 to leg 110 to prevent movement of bracket 214 along leg 110. Bracket 214 may include a spring-biased pin, for example, that engages with one or more holes formed in leg 110 to fix a position of bracket 214. In that case, to move bracket 214 (e.g., when collapsing bench 100, as described in detail below), the user pulls on the pin to withdraw the pin from the locking hole. With the pin removed, bracket 214 is free to slide along leg 110. In other implementations, though, other locking mechanisms may be used. For example, bracket 214 may comprise a friction mechanism whereby, to prevent movement of bracket 214, a control is pressed against a surface of leg 110. In that case, the control may comprise a pin that is screwed through bracket 214 against a surface of leg 110. Alternatively, the control may comprise a cam structure that, when engaged, operates as a chock to prevent movement of bracket 214 along a length of leg 110. In one implementation, bracket 214 includes nylon or plastic bushings to assist in movement of bracket 214 along leg 110.

When bench 100 is deployed, as shown in FIGS. 1 and 2, table 114 of bench 100 is partially supported by table bracket 226. Additionally, the position of bracket 214 along leg 110 is fixed by support arm 222, which is mounted to each of bracket 214 and front leg 108. The combination of bracket 214 and support arm 212 provide a second fixed support point for table 114. In other implementations, as described above, a locking mechanism connected to bracket 214, as described above, may be used to fix a position of bracket 214.

Returning to FIG. 1, gun mount assembly 124 is adjustably mounted to table 114. Gun mount assembly 124 includes mount 126 that provides a stable receptacle in which to rest a weapon. Mount 126 may be used to support many types of weapons including those that incorporate barrels such as rifles, shotguns, and pistols having sufficiently long barrels.

A number of control devices are connected to gun mount assembly 124 to allow for controlled movement of mount 126 vertically, laterally, and longitudinally with respect to table 114 of bench 100. For example, with reference to FIG. 1, vertical or height control 128 allows a user to modify a height of mount 126 with respect to table 114 of bench 100. Lever 132 allows a user to modify a position of mount 126 longitudinally with respect to table 114 of bench 100. Lever 130 allows a user to modify a position of mount 126 laterally with respect to table 114 of bench 100. As can be seen in FIG. 1, by positioning each of controls 130 and 132 nearby table 114 rather than mount 124, each of the controls are made easier to reach by a marksman using bench 100. If the controls were to be mounted directly on mount 124, for example, the controls would be out of reach to a marksman using bench 100. In that case, to adjust mount 124, the marksman would be required to stand-up from seat 112, move to the front of table 100, and make the necessary adjustment. In both cases of target shooting and hunting, such a movement would be greatly disruptive.

Figure 4:
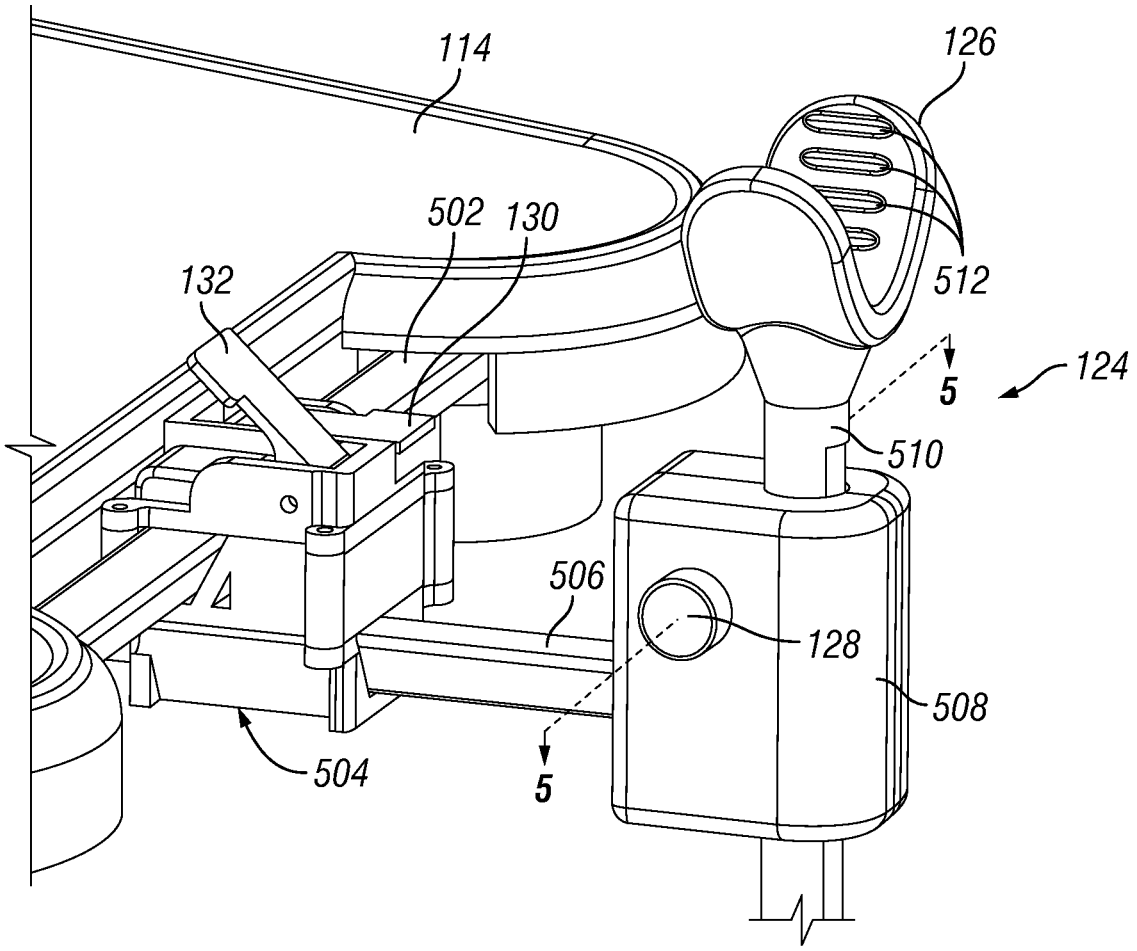
FIG. 4 is a view of the shooting bench showing additional detail of the gun mount assembly.

FIG. 4 is an illustration showing additional detail of gun mount assembly 124. Cam assembly 504 of gun mount assembly 124 is mounted to cross bar 502. Cross bar 502 is, in turn, mounted to the front of table 114. Cam assembly 504 is configured to optionally be moved back and forth along a length of cross bar 502. In one implementation, cam assembly 504 includes nylon or plastic bushings to assist in movement of cam assembly 504 along cross bar 502. By positioning cam assembly 504 along a length of cross bar 502, a user of bench 100 can position mount 126 at a preferred position laterally with respect to table 114 of bench 100. After cam assembly 504 is appropriately positioned on cross bar 502, the position of cam assembly 504 can be fixed using control 130.

In the implementation depicted in FIG. 4, control 130 comprises a cam lever which, when engaged presses against a surface of cross bar 502 preventing movement of cam assembly 504 along cross bar 502. When the cam lever is raised (see, for example, the raised position of control 132 shown on FIG. 4), the cam surface of the cam lever is withdrawn from cross bar 502 and cam assembly 504 is free to move back and forth along cross bar 502.

In other implementations, control 130 may comprise any suitable control device for selectively restricting movement of cam assembly 504 along cross bar 502. For example, control 130 may comprise a biased pin mechanism that is configured to engage with a number of holes formed in the top surface of cross bar 502 to fix a position of assembly 504. In that case, to move assembly 504, the user pulls on the pin to withdraw the pin from the locking hole, slides assembly 504 to the desired position, and then releases the pin so that the pin may reengage with an appropriate locking hole in the new location.

Control 130 could also include a threaded bolt which, when screwed into (and at least partially through) assembly 504 presses against a surface of cross bar 502 to prevent movement of assembly 504. In that case, to move assembly 504 the user unscrews the bolt so that the tip of the bolt is withdrawn from the surface of cross bar 502.

Cam assembly 504 is also connected to extension bar 506. Extension bar 506 is configured to slide in and out of cam assembly 504 to allow mount 126 to be moved either towards or away from table 114 of bench 100. Once the desired position of mount 126 (and extension bar 506) is established, the position of extension bar 506 can be fixed with respect to cam assembly 504 using control 132.

In the implementation depicted in FIG. 4, control 132 comprises a cam lever which, when engaged presses against a surface of extension bar 506 to prevent movement of extension bar 506 into and out of cam assembly 504. When the cam lever is raised (see, for example, the raised position of control 132 as shown on FIG. 4), the cam surface of the cam lever is raised away from extension bar 506 and extension bar 506 is free to move into and out of cam assembly 504.

In other implementations, control 132 may comprise any suitable control device for selectively restricting movement of extension bar 506 within cam assembly 504. For example, control 132 may comprise a biased pin mechanism that is configured to mate with a number of holes formed in the top surface of extension bar 506 to fix a position of extension bar 506 within assembly 504. In that case, to move extension bar 506 the user pulls on the pin to withdraw the pin from the locking hole, slides extension bar 506 within assembly 504 to the desired position, and then releases the pin so that it may reengage with an appropriate locking hole in the new location.

Control 132 could also include a threaded bolt which, when screwed into assembly 504, presses against a surface of extension bar 506 to prevent movement of extension bar 506 within assembly 504. In that case, to move extension bar 506 within assembly 504, the user unscrews the bolt so that the tip of the bolt is withdrawn from the surface of extension bar 506.

Extension bar 506 is connected to elevation assembly 508 that is, in turn, connected to elevation bar 510. Elevation bar 510 is connected to mount 126. Elevation bar 510 is configured to slide up and down within elevation assembly 508. The position of elevation bar 510 within elevation assembly 508 is controlled using control 128.

Figure 5A:
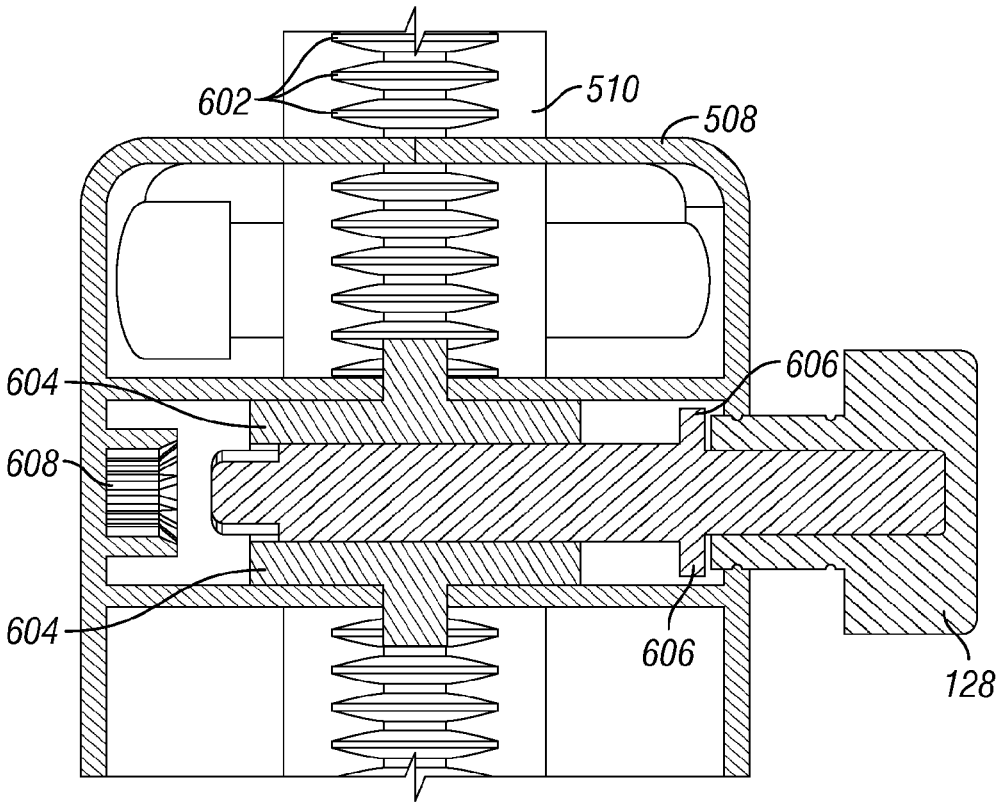
FIG. 5A is a cross-sectional illustration showing the interior of an elevation assembly for an adjustable weapon mount.
Figure 5B:
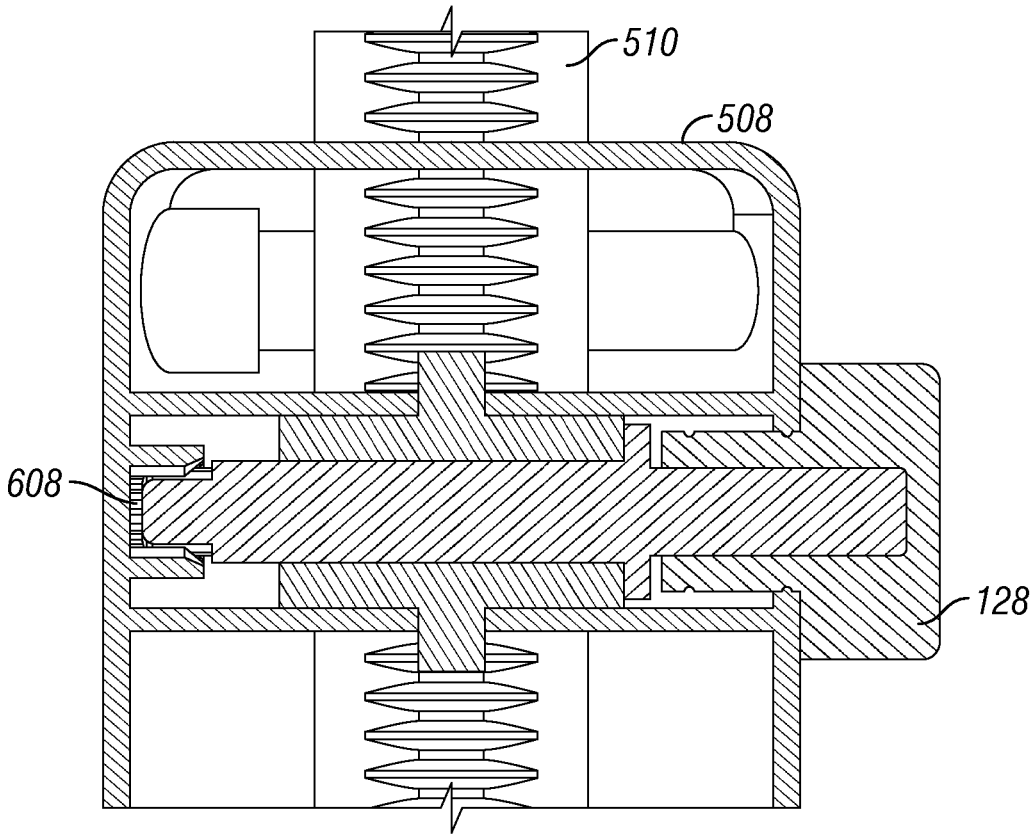
FIG. 5B is a cross-sectional illustration showing the interior of the elevation assembly for a locked weapon mount.

To further illustrate the operation of elevation assembly 508, FIGS. 5A and 5B are illustrations showing a portion of the interior of elevation assembly 508. Each of FIGS. 5A and 5B is generated by taking a cross-section of elevation assembly 508 through plane 5 of FIG. 4 where the respective view is taken facing forward, away from table 114 of bench 110. FIG. 5A illustrates the interior of elevation assembly 508 when the height of mount 126 (see FIG. 4) is adjustable, and FIG. 5B illustrates the interior of elevation assembly 508 when the height of mount 126 (see FIG. 4) is locked or fixed.

Referring to FIG. 5A, a number of horizontal teeth 602 are formed along the rear surface of elevation bar 510.

Control 128 comprises a bolt that extends into the interior volume of elevation assembly 508. Control 128 is rotatable within housing 604 of elevation assembly 508. Control 128 can also be pushed into, or pulled out of assembly 508 by some distance. Stop 606 prevents control 128 from being withdrawn from assembly 508 entirely.

A number of teeth (not shown) are formed around the shaft of control 128. The teeth formed around control 128 are configured to mate with teeth 602 of elevation bar 510 so that when control 128 is rotated within assembly 508, elevation bar 510 is moved either upwards or downwards and the combination of control 128 with elevation bar 510 operating as a rack and pinion mechanism. As such, by rotating control 128, a user can control the height of mount 126 (see FIG. 4) with respect to table 114 of bench 100.

After positioning mount 126 at the desired height, the elevation bar 510 can be locked so that elevation bar 510 cannot move with respect to elevation assembly 508. FIG. 5B shows control 128 in the locked position.

As shown in FIG. 5B, control 128 has been pushed into assembly 508 so that the tip of control 128 contacts lock structure 608, thereby locking elevation bar 510.

Lock structure 608 comprises a recess formed within a wall of elevation assembly 508. Teeth are formed around an inner surface of lock structure 608. When control 128 is pushed into assembly 508, another set of teeth formed around an exterior surface of the tip of control 128 mate with the teeth formed around the inner surface of lock structure 608. By mating the teeth of lock structure 608 and the tip of control 128, rotation of control 128 is prevented. Because the teeth formed around the midsection of control 128 continue to mate with teeth 602 of elevation bar 510, elevation bar 510 cannot move into or out of assembly 508. As such, the height of mount 126 (see FIG. 4) is fixed. To unlock control 128, the user pulls control 128 out of assembly 508 so that the tip of control 128 is withdrawn from lock structure 608. As mentioned above, stop 606 prevents the user from removing control 128 from assembly 508 entirely.

In other implementations, control 128 may include any suitable device for locking a position of elevation bar 510 with respect to elevation assembly 508. For example, control 128 could include a cam lever that, when closed, engages with a surface of elevation bar 510 to prevent movement of elevation bar 510. Alternatively, control 128 may include a threaded bolt that, when screwed into assembly 508, pushes against a surface of elevation bar 510 to prevent movement of elevation bar 510. In another implementation, control 128 includes a biased pin that is configured to be selectively engaged with one of a number of locking holes formed along a length of elevation bar 510.

Returning to FIG. 4, a user of bench 100, therefore, can use a combination of controls 128, 130 and 132 to precisely position mount 126. The various controls can be used to select a longitudinal position, lateral position, and a height of mount 126 with respect to table 114 of bench 100.

Mount 126 comprises a structure sized to receive and support a number of weapons that may be used in conjunction with bench 100. In one implementation, mount 126 includes a powder-coated metal, but other materials such as solid rubbers or plastics could be used. A number of ribs 512 are formed on an interior surface of mount 126 to provide additional support for a weapon placed within mount 126. Ribs 512 additionally create friction to prevent rotation of the weapon within mount 126. In one implementation, to minimize the weight of bench 100, mount 126 is hollow. To facilitate positioning of a weapon into mount 126, mount 126 is configured to swivel about the connection between mount 126 and elevation bar 510.

Bench 100 is collapsible. FIGS. 6A and 6B show perspective and side views of bench 100 in the collapsed configuration, respectively. To collapse bench 100, front leg 108 is brought backwards towards back leg 100. As front leg 108 moves backwards, support arm 222 pushes against bracket 214 causing bracket 214 to move backwards along leg 110. At the same time, table 114, being connected to both bracket 214 and table bracket 226, pulls table bracket 226 backwards along leg 100. In one implementation, table bracket 226 includes nylon or plastic bushings to assist in movement of table bracket 226 along leg 110. As front leg 108 moves backwards, because of their respective pivot connections, support arm 222, and support arm 212 are able to collapse and lay more parallel to both front leg 108 and back leg 110.

To provide stability to bench 100 when collapsed and to prevent bench 100 from opening when lifted, an optional latching mechanism may be incorporated into bench 100 to fix back leg 110 to front leg 108 when bench 100 is collapsed. In the present implementation, the latching mechanism is incorporated into bracket 214 and configured to connect to latch bracket 702 when bench 100 is collapsed. A control connected to bracket 214 can be used to release latch bracket 702 when the bench is to be deployed.

Figure 7:
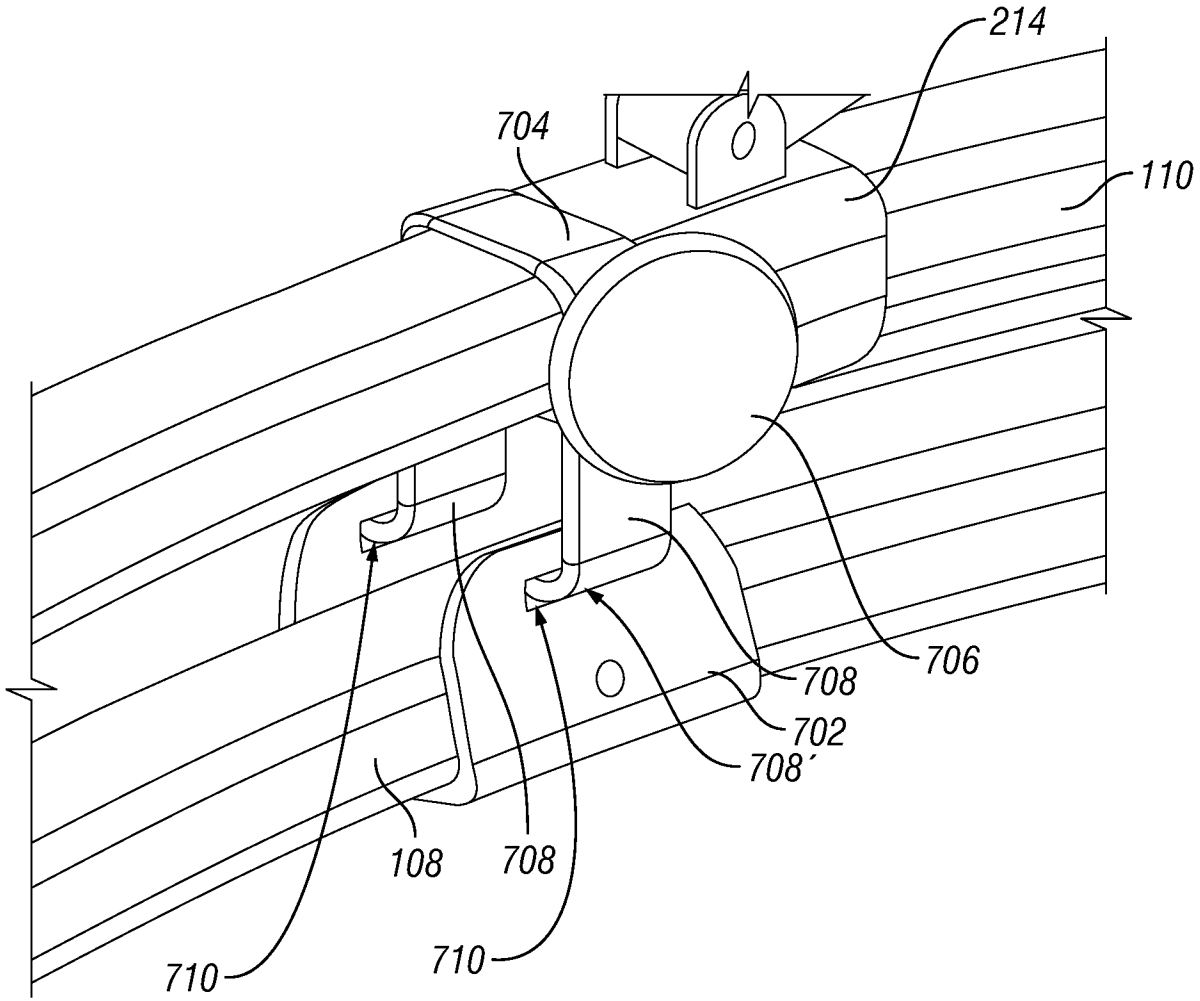
FIG. 7 is a detailed view of a latching mechanism and corresponding latch bracket for locking the shooting bench in a collapsed configuration.

FIG. 7 is a detailed view of latching mechanism 704 of bracket 214 and latch bracket 702. As shown in FIG. 7, latch bracket 702 is mounted around front leg 108. Latching mechanism 704 is connected to bracket 214. Control 706 is incorporated into latching mechanism 704 for controlling latching mechanism 704.

The body of latching mechanism 704 is sized so that latching mechanism 704 can move laterally with respect to back leg 110 and bracket 214. Movement of latching mechanism 704 is controlled using control 706. A bias spring (not shown) is configured to bias the body of latching mechanism 704 so that the portion of the latching mechanism to which control 706 is mounted is pressed against bracket 214 (i.e., latching mechanism 704 is biased towards the left side of bench 100).

Latching mechanism 704 includes two hooks 708 that protrude from the body of latching mechanism 704 below latching mechanism 704 and leg 110. Hooks 708 are configured to engage with slots 710 formed in the walls of latch bracket 702. Hooks 708 are configured with sloping lower surfaces 708'.

When collapsing bench 100 into its stowed position, legs 110 and 108 are brought together. As the legs collapse, latching mechanism 704 and, specifically, hooks 708 are brought towards latch bracket 702. The lower surfaces of hooks 708 first contact the walls of latch bracket 702. Due to the sloping bottom surface 708' of hooks 708, the force of the walls of latch bracket 702 pressing against the lower surface of hooks 708 causes the body of latching mechanism 704 to move towards the right side of bench 100, causing the bias spring of latching mechanism 704 to compress. The movement of latching mechanism 704 moves hooks 708 out of the way of the walls of latch bracket 702 allowing latch 704 and latch bracket 702 to continue moving towards one another. Eventually, as bench 100 is collapsed, slots 710 of latch bracket 702 fall in-line with the leading edge of hooks 708. Hooks 708 are then forced into slots 710 by the bias spring of latch 704. This locks latching mechanism 704 (and, consequently bracket 214 and leg 110) to latch bracket 702 (and, consequently, leg 108) locking bench 100 in its collapsed configuration.

To uncollapse bench 100, the user first pulls on control 706 of latching mechanism 704 to compress the bias spring of latching mechanism 704 thereby withdrawing hooks 708 from slots 710 of latch bracket 702. With hooks 708 withdrawn from slots 710, the two legs 108 and 100 can be separated and bench 100 can be deployed.

Figure 8:
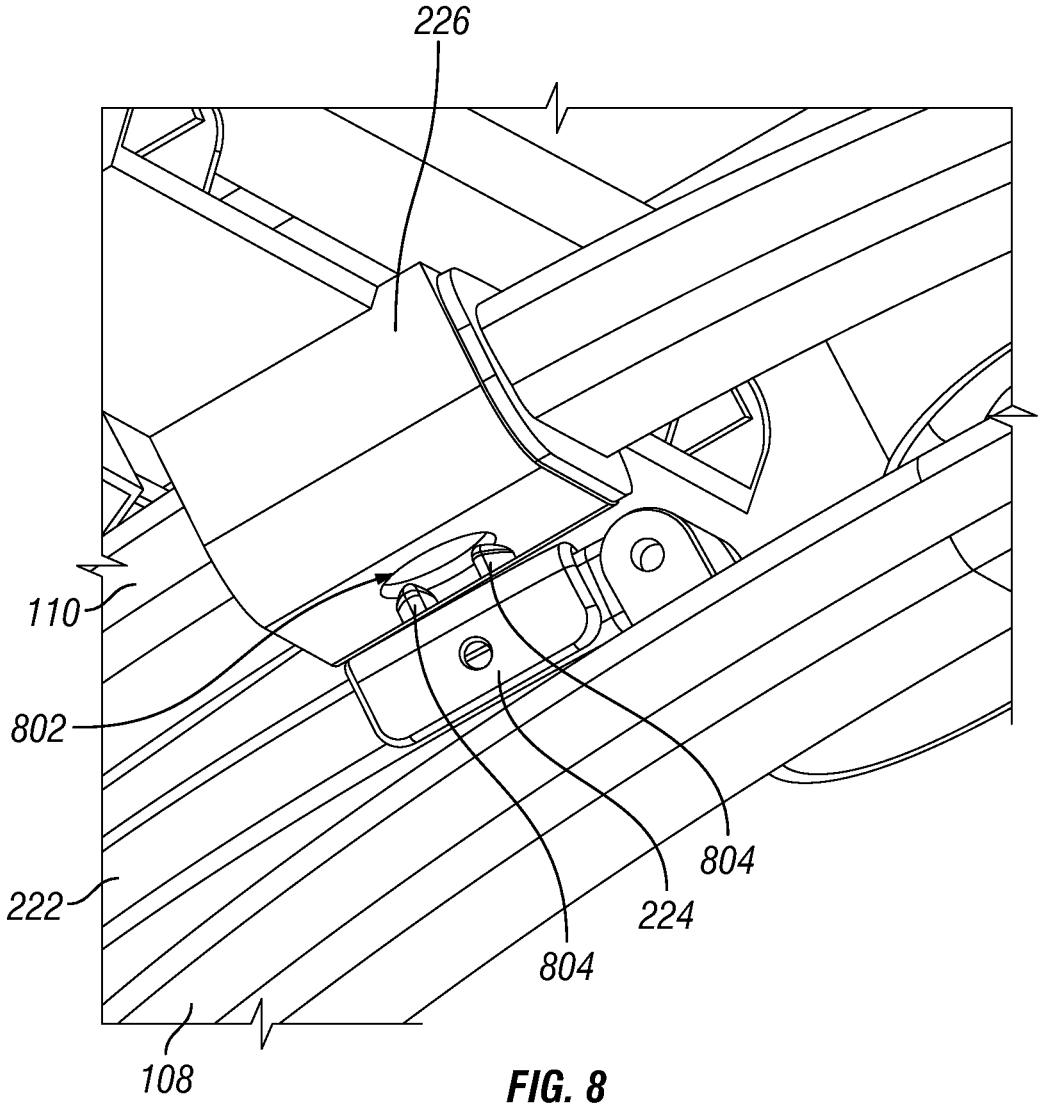
FIG. 8 is a detail view showing a leg-mounted stabilizer in combination with a table bracket to support the shooting bench in a collapsed configuration.

To provide additional stability when bench 100 is in its collapsed configuration, an optional front latch stabilizer 224 (see FIG. 2) can be mounted to support arm 222. As bench 100 is collapsed, stabilizer 224 moves towards and eventually couples with table bracket 226. FIG. 8 shows additional detail of stabilizer 224 and table bracket 226. As shown, hole 802 is formed in the lower surface of table bracket 226. The top surface of stabilizer 224 includes projections 804 that are configured to mate with hole 802. When bench 100 is collapsed and legs 108 and 110 come together (see, for example, FIGS. 6A and 6B showing bench 100 in its collapsed configuration), projections 804 engage with hole 802 to prevent movement of legs 108 and 110 laterally with respect to one another.

To deploy bench 100, the processes described above are reversed. Control 706 is first operated to unlock latching mechanism 704 and allow back leg 110 to move away from front leg 108. As back leg 110 moves away from front leg 108, bracket 214 is pulled forwards by support arm 222. The combination of bracket 214, support arm 212, and table bracket 226 support table 114 in its deployed configuration. As bracket 214 moves forward along leg 110, bracket 214 eventually reaches its deployed configuration (i.e., the position of bracket 214 as shown in FIGS. 1 and 2) and bench 100 is fully deployed. As that point, if bracket 214 includes a locking mechanism, bracket 214 may be locked into position.

The positioning of seat 112 in either its deployed or stowed position can be performed either before, after, or coincident with the collapsing or deployment of bench 100 in general—the two operations are independent of one another.

Although the present invention has been described with respect to preferred embodiment(s), any person skilled in the art will recognize that changes may be made in form and detail, and equivalents may be substituted for elements of the invention without departing from the spirit and scope of the invention. Therefore, it is intended that the invention not be limited to the particular embodiments disclosed for carrying out this invention, but will include all embodiments falling within the scope of the appended claims.

What is claimed is:

1. A shooting bench, comprising:

a frame including at least two legs, the at least two legs being connected at a pivot;

a table connected to the frame at a first bracket, the first bracket being configured to slide along a length of a first one of the at least two legs to transition the shooting bench between a deployed configuration and a collapsed configuration, the table including a cross bar;

a gun mount adjustably coupled to the cross bar of the table;

a first locking device mounted to the cross bar and configured to selectively permit movement of the gun mount in a first direction with respect to the table; and a second locking device mounted to the cross bar and configured to selectively permit movement of the gun mount in a second direction with respect to the table.

2. The shooting bench of claim 1, wherein the gun mount includes a height adjustment control configured to selectively modify a height of the gun mount with respect to the table.

3. The shooting bench of claim 1, wherein the gun mount comprises a powder-coated metal.

4. The shooting bench of claim 1, wherein at least one of the first and second locking devices includes a locking cam.

5. The shooting bench of claim 1, including:

a seat mounted to the frame; and a chest plate mounted to the table between the table and the seat.

6. The shooting bench of claim 1, including a seat mounted to the frame, the seat being configured to be selectively repositioned between a stowed position and a deployed configuration.

7. The shooting bench of claim 6, wherein, when the seat is disposed in the deployed configuration, the seat has a forward cant with respect to the table.

8. The shooting bench of claim 1, wherein the table comprises at least one arm rest, the arm rest including a cushioned surface.

9. A shooting bench, comprising:

a frame including at least a first leg and a second leg;

a table connected to the frame at a first bracket, the first bracket being configured to slide along a length of the first leg to transition the shooting bench between a deployed configuration and a collapsed configuration, wherein when the shooting bench is in the collapsed configuration, the first leg and the second leg are in a spaced configuration;

a gun mount adjustably coupled to the table; and a chest plate mounted to the table.

10. The shooting bench of claim 9, wherein the table includes:

a first locking device configured to selectively permit movement of the gun mount in a first direction with respect to the table, and a second locking device configured to selectively permit movement of the gun mount in a second direction with respect to the table.

11. The shooting bench of claim 10, wherein at least one of the first and second locking devices includes a locking cam.

12. The shooting bench of claim 9, wherein the gun mount includes a height adjustment control configured to selectively modify a height of the gun mount with respect to the table.

13. The shooting bench of claim 9, wherein the gun mount comprises a powder-coated metal.

14. The shooting bench of claim 9, including a seat mounted to the frame, the seat being configured to be selectively repositioned between a stowed position and a deployed configuration.

15. The shooting bench of claim 14, wherein, when the seat is disposed in the deployed configuration, the seat has a forward cant with respect to the table.

* * * * *